United States Patent [19]

Schinbeckler

[11] Patent Number: 4,766,882

[45] Date of Patent: Aug. 30, 1988

[54] POURED FLUE ADAPTER

[75] Inventor: Steven E. Schinbeckler, Brownsburg, Ind.

[73] Assignee: Wright-Bachman, Inc., Indpls., Ind.

[21] Appl. No.: 59,496

[22] Filed: Jun. 8, 1987

[51] Int. Cl.[4] ..... F23J 13/00

[52] U.S. Cl. ..... 126/315; 126/81; 126/82; 126/123

[58] Field of Search ..... 126/123, 318, 317, 315, 126/81, 82

[56] References Cited

U.S. PATENT DOCUMENTS

| | | | |
|---|---|---|---|
| 1,213,022 | 1/1917 | Rossi | 126/317 |
| 2,481,098 | 9/1949 | Fishko | 126/317 |
| 2,791,213 | 5/1957 | Goulding, Sr. . | |
| 3,940,837 | 3/1976 | Wiese . | |
| 4,026,264 | 5/1977 | Henriques . | |
| 4,173,923 | 11/1979 | Snook | 126/318 X |
| 4,207,862 | 6/1980 | Meyer | 126/123 |
| 4,230,092 | 10/1980 | Henriques | 126/126 |
| 4,261,325 | 4/1981 | Duncan et al. . | |
| 4,305,374 | 12/1981 | Tayler | 126/121 X |
| 4,329,973 | 5/1982 | Scullin, Jr. | 126/123 |
| 4,424,794 | 1/1984 | Page . | |
| 4,527,541 | 7/1985 | Roberts . | |
| 4,584,986 | 4/1986 | Cannata | 126/123 |
| 4,683,623 | 4/1987 | Cannata | 126/123 |

*Primary Examiner*—Larry Jones

*Attorney, Agent, or Firm*—Woodard, Emhardt, Naughton Moriarty & McNett

[57] ABSTRACT

A method for installing a poured flue adapter within a fireplace is disclosed which comprises providing a plate to be received within the fireplace, the plate having a central aperature within which is positioned a slip connector having a cylindrical portion for connection with the flue of a fireplace insert and a flange which rests against a gasket on the top side of the plate surrounding the central aperture, attaching the flange of the slip connector through the gasket and through the plate, securing two U-bolts to the upper side of the plate for being embedded within a cementitious material, and positioning the plate within the chimney and applying the cementitious material to the upper side to secure the plate assembly in position. A poured flue adapter useful in the foregoing method is also described.

14 Claims, 2 Drawing Sheets

POURED FLUE ADAPTER

BACKGROUND OF THE INVENTION

1. Field of the Invention

The present invention relates to the field of adapters for permitting installation of a fireplace insert within a fireplace, and more particularly to an adapter useful in association with a poured flue within the fireplace chimney.

2. Description of the Prior Art

The use of fireplace inserts has become increasingly popular due to the advantages of such inserts, for example with respect to heating efficiency. Conventional fireplaces frequently create strong drafts which draw heat up from the room and through the chimney rather than contributing heat to the room. Fireplace inserts can be designed to be installed within an existing fireplace, and adapted to use the chimney as the flue for the insert. The resulting adaptation provides a system which has the advantages of comprising an efficient heating system with good aesthetics and using similar fuel, while overcoming some of the disadvantages associated with the prior fireplace unit.

In order to install a fireplace insert, it is necessary to provide for adapting the chimney to receive the flue extending from the insert. In general, there is usually provided a plate which substantially encloses the bottom of the chimney, while providing an aperture to which the insert flue connects. In some installations, the lower end of the chimney is closed off with poured concrete.

In one known system, a piece of hard rubber or plywood is positioned at the bottom of the chimney and the concrete is poured thereon. Provision is made for forming an aperture within the poured liner for reception of the flue from the fireplace insert or other woodburning appliance. Most of the time, the pour is made as close to the top of the woodburning appliance as possible, and no connector is used between the appliance and the flue. Another approach has been to use an increaser (such as an 8 to 10 inch round conduit) and embedding the larger portion within the pour. The insert flue is then connected to the bottom portion of the increaser, but this will create problems due to expansion and contraction of the metal. Also, the connection is difficult to make because this approach does not employ a slip connector.

There has remained a need to have a method for installing a poured flue adapter within a fireplace which provides a proper connection between the flue of the woodburning appliance and the poured liner. The connection desirably needs to be one which is easily accomplished and which avoids problems which could occur due to expansion and contraction of different metal components.

In U.S. Pat. No. 4,026,265 issued to Enriquez on May 31, 1977, there is described a portable fireplace heating unit for installation within an existing fireplace. The Enriquez Patent describes different types of damper adapters for connecting the unit with the existing fireplace. The connection is provided by means of an adapter plate and an insert mounted thereto for connection with a damper flue conduit. The direct interconnection of these various plates and conduits can introduce the problems previously mentioned regarding expansion and contraction of metal components at different temperatures.

Other flue adapters which connect with the chimney in similar fashions are disclosed in U.S. Pat. Nos. 4,527,541 issued to Roberts on July 9, 1985; 2,791,213 issued to Golding on May 7, 1957; and 4,424,794 issued to Paige on Jan. 10, 1984.

The use of insulation material between a furnace and a flue collar is shown in U.S. Pat. No. 4,261,325 issued to Duncan, et al. on Apr. 14, 1981. The flue collar includes a parametric flange which defines a shoulder received against an annular insulating member and the surface of the stove. A similar configuration for a furnace having a heat exchanger is described in U.S. Pat. No. 3,940,837 issued to Wiese on Mar. 2, 1976.

SUMMARY OF THE INVENTION

A method for installing a poured flue adapter within a fireplace is disclosed which includes mounting an apertured plate in position adjacent the bottom of the fireplace chimney, a slip connector being positioned within the aperture of the plate and having a flange mounted to the plate with an insulating gasket therebetween, and pouring a cementitious material into the flue and against the plate to secure the plate and slip connector in position.

In an alternate embodiment, a poured flue adapter is provided which includes an apertured plate, a gasket surrounding the aperture, and a slip connector extending through the aperture and having a flange mounted through the gasket to the plate.

It is an object of the present invention to provide a method for installing a poured flue adapter within a fireplace which is relatively simple and efficient.

Another object of the present invention is to provide a method for installing a poured flue adapter which provides a slip connector mounted within the chimney and attachable to the flue of the fireplace insert.

It is a further object of the present invention to provide a poured flue adapter which is designed for mounting within a fireplace chimney and for connection with the flue of a fireplace insert.

Another object of the present invention is to provide a method and apparatus which yields a drip free connection between a fireplace chimney and the flue of a fireplace insert.

Further objects and advantages of the present invention will be apparent from the description of the preferred embodiment which follows.

DESCRIPTION OF THE PREFERRED EMBODIMENT

Figure 1:
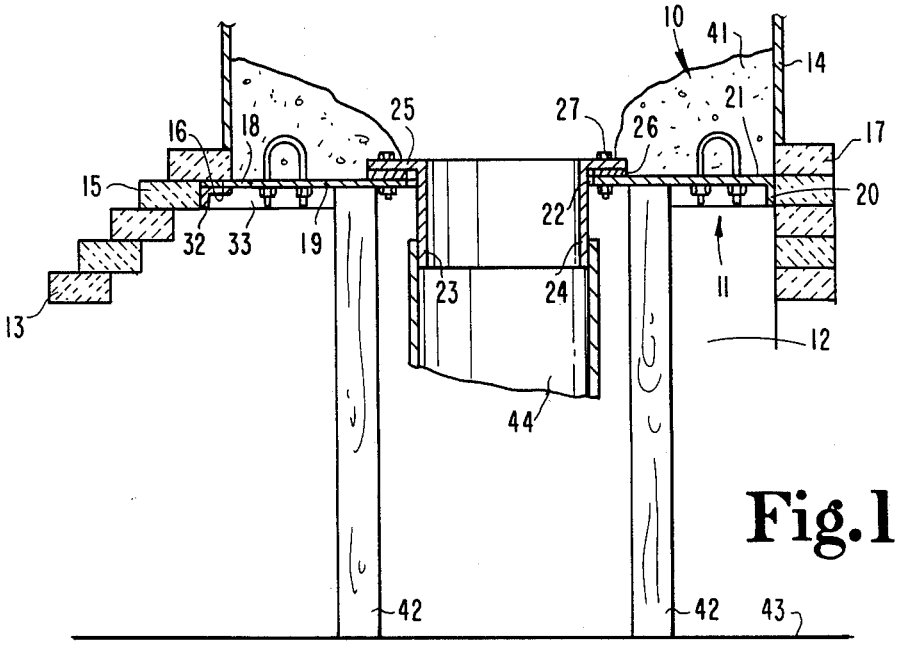
FIG. 1 is a side, cross-sectional view showing the poured flue adapter of the present invention shown mounted within a fireplace.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention provides an apparatus and method for a poured flue adapter to be mounted within a fireplace. In the preferred embodiment, the adapter 10 is mounted within the fireplace at the underneath side of the top of the throat 11 of the smoke chamber 12. The throat 11 is defined by the fireplace 13, typically by the tapering of the smoke chamber to the flue tile 14. Adjacent the lower end of the flue tile, the tapering bricks 15 define an inwardly and downwardly facing shoulder 16. This shoulder will typically extend about three of the four sides of a rectangular throat, with the back 17 of the fireplace typically extending straight upwards.

The adapter 10 includes a plate 18 having a flat main portion 19 and a downwardly-extending flange 20 along the rear edge 21. The plate 18 is sized and configured to be received adjacent the downwardly facing shoulder 16 and to overlap the shoulder along the three defined sides. The inwardly extending flange 20 is positioned adjacent the rear wall 17 when the plate is so positioned against the shoulder 16. The plate 18 includes a central aperture 22. A slip connector 23 is receivable through the aperture 22 and against the top of the plate 18. In particular, slip connector 23 includes a cylindrical portion 24 which is sized to be received through the aperture 22. The aperture 22 is larger than the outside diameter of the cylindrical portion of the portion 24 so that the cylindrical portion is spaced apart from the flat portion 19 of the plate 18 when the slip connector is in the position as shown in FIG. 1. This prevents direct metal contact between the slip connector and the plate in the region of the aperture.

Figure 2:
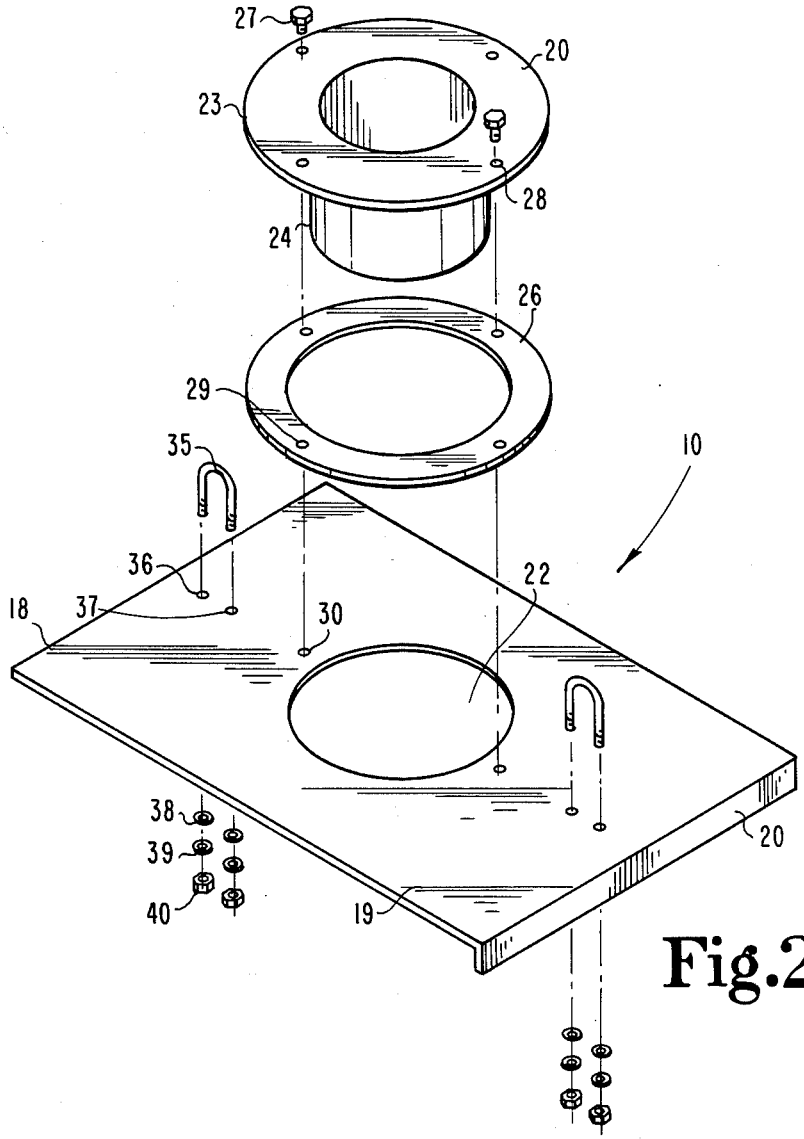
FIG. 2 is an exploded, perspective view showing the relationship of several of the components of the poured flue adapter of the present invention.

Slip connector 23 also includes a radially-extending flange 25 at one end. An annular gasket 26 is positioned about the central aperture 22, and the flange 25 is received against the gasket. The gasket 26 thereby prevents direct metal contact between the flange 25 and the plate 18. Means are provided for attaching flange 25 with the plate 18, which may conveniently take the form of sheet metal or TEK screws, such as 27, which extend through aligned apertures 28–30 in the flange 20, gasket 26 and plate 18, respectively (FIG. 2).

Figure 3:
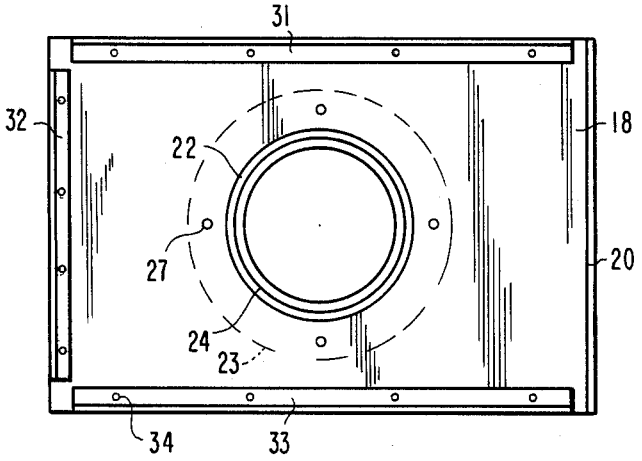
FIG. 3 is a bottom, plan view showing the poured flue adapter of FIG. 1, and particularly showing the attachment of the angle bars to the underside of the adapter plate.

The strength of the plate 18 is increased by the presence of the flange 20 along the rear edge. In addition, angle bars 31–33 (FIG. 3) may be mounted to the underside of the plate for added reinforcement. The angle bars may be secured to plate 18 by means such as sheet metal or TEK screws, such as 34.

Attachment members may be secured to the plate 18 to facilitate engagement of the adapter with the poured concrete used to secure the slip connector within the chimney. As shown in FIG. 2, these attachment members may preferably take the form of U-bolts, such as 35, which are received through apertures 36 and 37 in the plate 18. The U-bolt 35 is secured to the plate by means of washers 38, lock washers 39 and nuts 40 secured to the ends of the U-bolt. With the U-bolts secured in this fashion, the "U" portion of the bolts extends upwardly from the plate and will be embedded in the concrete 41 (FIG. 1) poured onto the adapter. By this manner of connection, the plate 18 and associated components may be removed from the chimney after installation by removing the nuts 40 and pulling the plate downward.

It will be apparent from the foregoing description that a poured flue adapter is provided by which an adapter may be readily mounted within a fireplace. Many of the foregoing components are preferably provided in the form of a kit which can be modified for installation within a variety of fireplace sizes. The plate 18 is provided as a substantially flat metal sheet with a downwardly-extending flange along one edge. The three other sides of the plate are cut to fit within a given fireplace. A template is then used to locate the central aperture which is then cut into the plate as desired. By providing the plate in this manner, the adapter can be readily modified to fit within fireplaces of a variety of sizes and shapes. Similarly, the aperture 22 may be cut into the plate at any appropriate location to receive the flue of the fireplace insert. In addition, various sizes of apertures can be used with corresponding modifications to the sizes of the gasket and slip connector, as required.

Once the flat, main portion of the plate has been appropriately sized, and the aperture formed, the slip connector is mounted as shown in FIG. 1. The angle bars 31–33 then be cut from bar stock and secured to the plate in the manner shown in FIG. 3. The U-bolts are then mounted to the plate, with there preferably being used two U-bolts positioned in diametrically opposed positions about the slip connector.

The assembled adapter is then positioned with the plate being received adjacent the downwardly facing shoulder of the fireplace. The plate may be held in position by any simple means, such as by bracing using scrap wood or the like, such as shown at 42, extending from the floor 43 of the fireplace. The cementitious material 41 is then poured in the appropriate position on top of the plate, and particularly in the region of the U-bolts. Prior to applying this cementitious material, a ceramic wool or other type of combustible filament may be used to fill any voids between the plate and the bottom of the throat. This cementitious material may comprise any suitable cement-like material, particularly that commonly used as mortar for brick fireplaces or the like. Once the cementitious material has set, the bracing is removed and the fireplace insert is connected with the slip connector.

As shown in FIG. 1, the flue 44 of the fireplace insert is preferably connected by being telescopically received about the cylindrical portion 24 of the slip connector. In this fashion, all creosote or condensation from the flue will drip into the connector assembly and run down into the woodburning or other appliance. No direct connection between the flue 44 and slip connector 23 is required, thus permitting free relative movement between the flue 44 and the connector 23. As indicated, the plate assembly can be removed at any later time by simply removing the nuts 40 from the U-bolts.

The method and apparatus of the present invention thus provides a poured flue adapter which achieves several advantages. The slip connector 23 is secured to the plate 18 without any direct metal contact between these two components. Rather, the cylindrical portion 24 is spaced inwardly from the plate within the aperture 22, and the gasket 26 provides spacing between the flange 25 of the slip connector and plate 18. This spacing and the use of the gasket thus eliminates heat transfer directly between the plate and the slip connector.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A poured flue adapter for insertion within a fireplace, the fireplace including a flue and an inwardly and downwardly facing shoulder below the flue, the adapter comprising:

a plate having a flat main portion having a rear edge and a flange extending downwardly from the rear edge, said plate being sized to be received adjacent the downwardly facing shoulder below the flue of the fireplace, said plate having an aperture in the flat portion of said plate;

angle bars secured to the underside of the flat portion of said plate adjacent the perimetric edge of said plate in the area other than the location of the downwardly-extending flange at the rear edge of said plate;

a gasket on the top of said plate surrounding the aperture;

a slip connector positioned within the aperture of said plate and against the top of said plate, said slip connector including a cylindrical portion extending through and spaced inwardly of the aperture and a radially-extending flange at one end of the cylindrical portion received against said gasket, said slip connector being free from direct contact with said plate;

attachment means for attaching the flange of said slip connector through said gasket and to said plate; and at least one attachment member secured to said plate and extending upwardly therefrom to be received within the flue of said fireplace when said plate is positioned against the downwardly facing shoulder.

2. The adapter of claim 1 in which said attachment member comprises at least one U-bolt secured to said plate in the orientation to have the "U" portion of the bolt extending upwardly from said plate.

3. The adapter of claim 2 in which said at least one attachment member comprises two U-bolts secured to said plate in diametrically-opposed positions.

4. The adapter of claim 1 in which said attachment means comprises screws extending through the flange of said slip connector and threadedly received by said plate.

5. The adapter of claim 4 in which said attachment member comprises at least one U-bolt secured to said plate in the orientation to have the "U" portion of the bolt extending upwardly from said plate.

6. The adapter of claim 5 in which said at least one attachment member comprises two U-bolts secured to said plate in diametrically-opposed positions.

7. A method for installing a poured flue adapter within a fireplace, the fireplace including a flue and an inwardly and downwardly facing shoulder below the flue, the method comprising the steps of:

a. providing a plate having a flat main portion having a rear edge and a flange extending downwardly from the rear edge;

b. sizing said plate to be received adjacent the downwardly facing shoulder below the flue of the fireplace;

c. providing an aperture in the flat portion of said plate;

d. positioning a gasket on the top of said plate surrounding the aperture;

e. positioning a slip connector within the aperture of said plate and against the top of said plate, said slip connector including a cylindrical portion extending through and spaced inwardly of the aperture and a radially-extending flange at one end of the cylindrical portion received against said gasket, said slip connector being free from direct contact with said plate;

f. attaching the flange of said slip connector through said gasket and to said plate;

g. providing at least one attachment member secured to said plate and extending upwardly therefrom to be received within the flue of said fireplace when said plate is positioned against the downwardly facing shoulder;

h. positioning said plate against the downwardly facing shoulder; and i. pouring a cementitious material against said plate to secure the plate in position within the fireplace and adjacent the downwardly facing shoulder.

8. The method of claim 7 and which further includes, after step b. and prior to step h., the step of securing angle bars to the underside of the flat portion of said plate adjacent the perimetric edge of said plate in the area other than the location of the downwardly-extending flange at the rear edge of said plate.

9. The method of claim 7 in which step h. comprises attaching at least one U-bolt to said plate in the orientation to have the "U" portion of the bolt extending upwardly from said plate.

10. The method of claim 9 in which step h. comprises the step of attaching two U-bolts to said plate in diametrically-opposed positions.

11. The method of claim 7 in which step f. comprises securing the flange of said slip connector with said plate by screws extending through the flange and threadedly received by said plate.

12. The method of claim 11 and which further includes, after step b. and prior to step h., the step of securing angle bars to the underside of the flat portion of said plate adjacent the perimetric edge of said plate in the area other than the location of the downwardly-extending flange at the rear edge of said plate.

13. The method of claim 12 in which step h. comprises attaching at least one U-bolt to said plate in the orientation to have the "U" portion of the bolt extending upwardly from said plate.

14. The method of claim 13 in which step h. comprises the step of attaching two U-bolts to said plate in diametrically-opposed positions.

* * * * *